US010072484B2

(12) United States Patent
Hallundbæk et al.

(10) Patent No.: US 10,072,484 B2
(45) Date of Patent: Sep. 11, 2018

(54) DOWNHOLE EXPANDABLE TUBULAR

(71) Applicant: WELLTEC A/S, Allerød (DK)

(72) Inventors: Jørgen Hallundbæk, Græsted (DK); Ricardo Reves Vasques, Holte (DK); Ivan Sciera Jensen, Hellerup (DK); Dean Richard Massey, Copenhagen K (DK); Lars Stæhr, Glostrup (DK)

(73) Assignee: Welltec A/S, Allerød (DK)

( * ) Notice: Subject to any disclaimer, the term of this patent is extended or adjusted under 35 U.S.C. 154(b) by 197 days.

(21) Appl. No.: 14/783,932

(22) PCT Filed: Apr. 11, 2014

(86) PCT No.: PCT/EP2014/057365
§ 371 (c)(1),
(2) Date: Oct. 12, 2015

(87) PCT Pub. No.: WO2014/167092
PCT Pub. Date: Oct. 16, 2014

(65) Prior Publication Data

US 2016/0053591 A1 Feb. 25, 2016

(30) Foreign Application Priority Data

Apr. 12, 2013 (EP) ..... 13163516

(51) Int. Cl.
*E21B 33/12* (2006.01)
*E21B 33/129* (2006.01)
*E21B 43/10* (2006.01)

(52) U.S. Cl.
CPC ..... *E21B 43/108* (2013.01); *E21B 33/12* (2013.01); *E21B 33/129* (2013.01); *E21B 43/103* (2013.01)

(58) Field of Classification Search
CPC ..... B21D 53/00; E21B 33/12; E21B 33/129; E21B 43/103; E21B 43/108; E21B 43/10
See application file for complete search history.

(56) References Cited

U.S. PATENT DOCUMENTS 2,275,080 A 3/1942 Kelly
2,400,495 A * 5/1946 Ford ..... B22D 13/023 138/109

(Continued)

FOREIGN PATENT DOCUMENTS

CN 2851544 Y 12/2006
CN 1891974 A 1/2007

(Continued)

OTHER PUBLICATIONS

Chinese Office Action mailed Apr. 5, 2017 in Chinese Application No. 201480018149.0, with English Translation (18 pages).

(Continued)

*Primary Examiner* — David J Bagnell
*Assistant Examiner* — Dany E Akakpo
(74) *Attorney, Agent, or Firm* — Nixon & Vanderhye P.C.

(57) ABSTRACT

The present invention relates to a downhole expandable tubular to be expanded in a well downhole from a first outer diameter to a second outer diameter to abut against an inner face of a casing or borehole, the downhole expandable tubular having an axial extension, wherein the downhole expandable tubular is made of metal and is machined from one metal tubular blank, providing the downhole expandable tubular with at least one circumferential projection. Furthermore, the present invention relates to an annular barrier, to a downhole completion comprising a downhole expandable tubular according to the present invention, to a downhole completion comprising a well tubular structure and an annular barrier according to the present invention and to a (Continued)

manufacturing method for the manufacture of the downhole expandable tubular according to the present invention.

19 Claims, 12 Drawing Sheets

(56) References Cited

U.S. PATENT DOCUMENTS

| | | | | |
|---|---|---|---|---|
| 2,921,632 | A * | 1/1960 | Clark, Jr. | E21B 33/1216 277/338 |
| 3,891,394 | A * | 6/1975 | Smith | B01D 9/0013 422/245.1 |
| 7,347,274 | B2 * | 3/2008 | Patel | E21B 33/128 166/120 |
| 7,360,592 | B2 * | 4/2008 | McMahan | E21B 23/01 166/206 |
| 8,479,549 | B1 * | 7/2013 | Fonte | B21C 37/06 148/519 |
| 2003/0047322 | A1 * | 3/2003 | Maguire | E21B 43/103 166/380 |
| 2011/0266004 | A1 | 11/2011 | Hallundbæk et al. | |
| 2016/0222754 | A1 | 8/2016 | Hallundbæk et al. | |

FOREIGN PATENT DOCUMENTS

| | | | |
|---|---|---|---|
| CN | 201412099 | Y | 2/2010 |
| CN | 102272413 | A | 12/2011 |
| CN | 102575508 | A | 7/2012 |
| GB | 2 404 677 | | 2/2005 |
| RU | 2 236 550 | C1 | 9/2004 |
| RU | 2 265 115 | C1 | 11/2005 |
| RU | 2 273 718 | C1 | 4/2006 |
| RU | 2 365 803 | C2 | 8/2009 |
| WO | WO 2007/021975 | A1 | 2/2007 |
| WO | WO 2012/175695 | A1 | 12/2012 |

OTHER PUBLICATIONS

Notification Concerning Transmittal of International Preliminary Report on 2015 Patentability dated Oct. 22, 2015 in International Application No. PCT/EP2014/057365 (8 pages).

International Search Report for PCT/EP2014/057365, dated Jun. 17, 2014, three pages.

Written Opinion of the ISA for PCT/EP2014/057365, dated Jun. 17, 2014, six pages.

Office Action of Substantive Examination dated Oct. 9, 2017 in Russian Application No. 2015145876/03(070690), with English Translation (10 pages).

Notification of the Second Office Action dated Dec. 7, 2017 in Chinese Application No. 201480018149.0, with English translation (19 pages).

* cited by examiner

DOWNHOLE EXPANDABLE TUBULAR

This application is the U.S. national phase of International Application No. PCT/EP2014/057365 filed 11 Apr. 2014 which designated the U.S. and claims priority to EP Patent Application No. 13163516.1 filed 12 Apr. 2013, the entire contents of each of which are hereby incorporated by reference.

FIELD OF THE INVENTION

The present invention relates to a downhole expandable tubular to be expanded in a well downhole. Furthermore, the present invention relates to an annular barrier, a downhole completion and a manufacturing method.

BACKGROUND ART

In wellbores, expandable tubulars are used for different purposes, such as for sealing off an opening in the casing, in the form of a patch or liner, for providing a barrier to flow between an inner and an outer tubular structure, or between an inner tubular structure and the inner wall of the borehole, in the form of an annular barrier, or for providing a liner hanger.

When manufacturing expandable tubulars, it is very important that the quality of the expandable tubular is very high, since an expandable tubular is exposed to high temperatures and pressures in the borehole. If the expandable tubular ruptures once it is in the well, it may be difficult to detect whether the expandable tubular functions as intended or whether it e.g. ruptures due to material flaws or process error, and thus it is very important to be able to manufacture high quality expandable tubulars.

SUMMARY OF THE INVENTION

It is an object of the present invention to wholly or partly overcome the above disadvantages and drawbacks of the prior art. More specifically, it is an object to provide an improved expandable tubular which can be expanded to a larger diameter than known downhole tubulars, without having to increase its thickness.

The above objects, together with numerous other objects, advantages and features, which will become evident from the below description, are accomplished by a solution in accordance with the present invention by a downhole expandable tubular to be expanded in a well downhole from a first outer diameter to a second outer diameter to abut against an inner face of a casing or borehole, the downhole expandable tubular having an axial extension, wherein the downhole expandable tubular is made of metal and is machined from one metal tubular blank, providing the downhole expandable tubular with at least one circumferential projection.

In an embodiment, the downhole expandable tubular may be machined, providing the downhole expandable tubular with at least one groove.

Moreover, the metal tubular blank may be made by centrifugal or spin casting.

The machining may be performed as milling, cutting or grinding or latheing.

Also, the tubular blank may have an inner diameter and an outer diameter, said blank being machined so as to increase the inner diameter and/or decrease the outer diameter.

Furthermore, the tubular blank may be made from steel or stainless steel.

In addition, the downhole expandable tubular may have a length and the downhole expandable tubular may be machined along the entire length.

Moreover, the downhole expandable tubular may be machined having at least one integrated end piece.

Said at least one end piece may have indentations on an outer face of the expandable tubular.

In an embodiment, the downhole expandable tubular may comprise several projections and/or at least one groove.

Also, a sealing element may be arranged between two adjacent projections or in the groove.

Additionally, the sealing element may be made of an elastomer, rubber, polytetrafluoroethylene (PTFE) or another polymer.

Further, a ring-shaped retaining element may be arranged between two adjacent projections or in the groove for pressing the sealing element in the axial extension towards an edge of the projection or groove.

Said ring-shaped retaining element may be a split ring.

Additionally, an intermediate element may be arranged between the ring-shaped retaining element and the sealing element.

Moreover, the intermediate element may be made of polytetrafluoroethylene (PTFE) or polymer.

Furthermore, the tubular blank may be made of any kind of metal, such as steel, stainless steel, iron, or more ductile materials, such as copper, aluminium, lead, tin or nickel. Instead of being made of metal, the tubular blank may be made of any kind of polymers, such as plastic. The tubular blank may be made of metal, steel, stainless steel, iron, copper, aluminium, lead, tin, nickel, polymers or any combination thereof.

The downhole expandable tubular according to the present invention may be a patch to be expanded within a casing or well tubular structure in a well, a liner hanger to be at least partly expanded within a casing or well tubular structure in a well, or a casing to be at least partly expanded within another casing.

The present invention further relates to an annular barrier to be expanded in an annulus between a well tubular structure and an inside face of a casing or borehole downhole for providing zone isolation between a first zone and a second zone of the casing or borehole, the annular barrier having an axial extension and comprising:

- a tubular part, the tubular part being a separate tubular part or a casing part for mounting a part of the well tubular structure,
- a downhole expandable tubular according to any of the preceding claims, the expandable tubular surrounding the tubular part, each end of the expandable tubular being connected with the tubular part and extending along the axial extension,
- an annular barrier space between the tubular part and the expandable tubular, and
- an expansion opening in the tubular part through which fluid may enter the space in order to expand the expandable tubular.

The annular barrier as described above may further comprise at least one sealing element surrounding the downhole expandable tubular.

Also, a sleeve may be arranged in between the downhole expandable tubular and the tubular part, the sleeve being connected with the tubular part and the downhole expandable tubular, thus dividing the space into a first space section and a second space section.

The annular barrier according to the present invention may comprise several sleeves squeezed in between the tubular part and the downhole expandable tubular.

Furthermore, the downhole expandable tubular may have an opening providing fluid communication between the first or the second zone and one of the space sections.

Additionally, the projection may be a ring-shaped projection of an increased thickness in relation to other parts of the downhole expandable tubular, the ring-shaped projection providing an enforcement of the annular barrier when the annular barrier is expanded.

Furthermore, the present invention relates to a downhole completion comprising a downhole expandable tubular according to any of the preceding claims, and a casing having an inner face against which at least part of the downhole expandable tubular may be expanded.

Also, the present invention relates to a downhole completion comprising a well tubular structure and an annular barrier as described above, where the tubular part of the annular barriers may be mounted as part of the well tubular structure.

Finally, the present invention relates to a manufacturing method for the manufacture of the downhole expandable tubular according to any of the preceding claims, comprising the steps of:

centrifugal or spin casting a metal tubular blank, machining the metal tubular blank to a decreased inner and outer diameter, and machining the metal tubular blank, providing it with at least one circumferential projection or groove.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
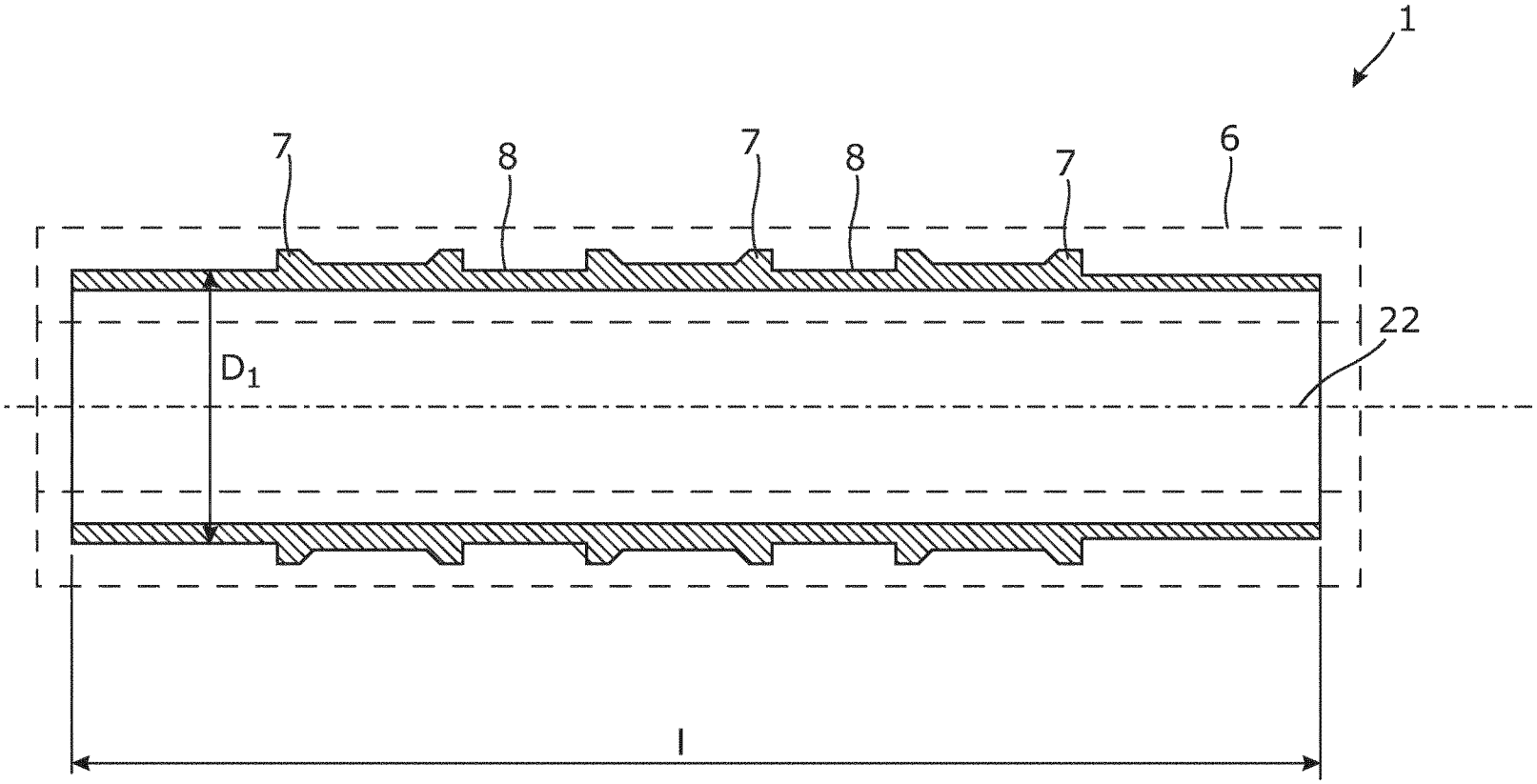
FIG. 1 shows a cross-sectional view of a downhole expandable tubular.

FIG. 1 shows a cross-sectional view of a downhole expandable tubular 1 to be at least partly expanded in a well downhole from a first outer diameter $D_1$ to a second outer diameter $D_2$ (shown in FIGS. 6 and 7) to abut against an inner face of a casing or borehole. The downhole expandable tubular is made of metal and is machined from one metal tubular blank 6, providing the downhole expandable tubular with at least one circumferential projection 7. In FIG. 1, downhole expandable tubular 1 has six projections 7 and two grooves 8, and the blank is indicated with dotted lines illustrating the material machined away to form the downhole expandable tubular 1 in one piece without subsequent use of welding.

In prior art, expandable tubulars are made with welded rings around the outer face of the expandable tubular in order to reinforce the expandable tubular in predetermined areas, and the making of the welded seam causes the material to change its properties, and the welding may thus cause the material to deteriorate so that the expandable tubular has a varying strength or ductility in these areas. Prior art expandable tubulars are typically made from a metal plate with a welded seam along the axial extension of the expandable tubular. Thus, the metal material is in some areas welded twice, while other areas are not welded, which results in varying expansion ability along the axial extension of the expandable tubular.

By machining the downhole expandable tubular from a blank having a substantially larger wall thickness, the downhole expandable tubular can be made with increased thickness, projections and grooves without having to weld rings onto the downhole expandable tubular which may result in the subsequent deterioration of the expansion ability of the downhole expandable tubular.

Figure 2:
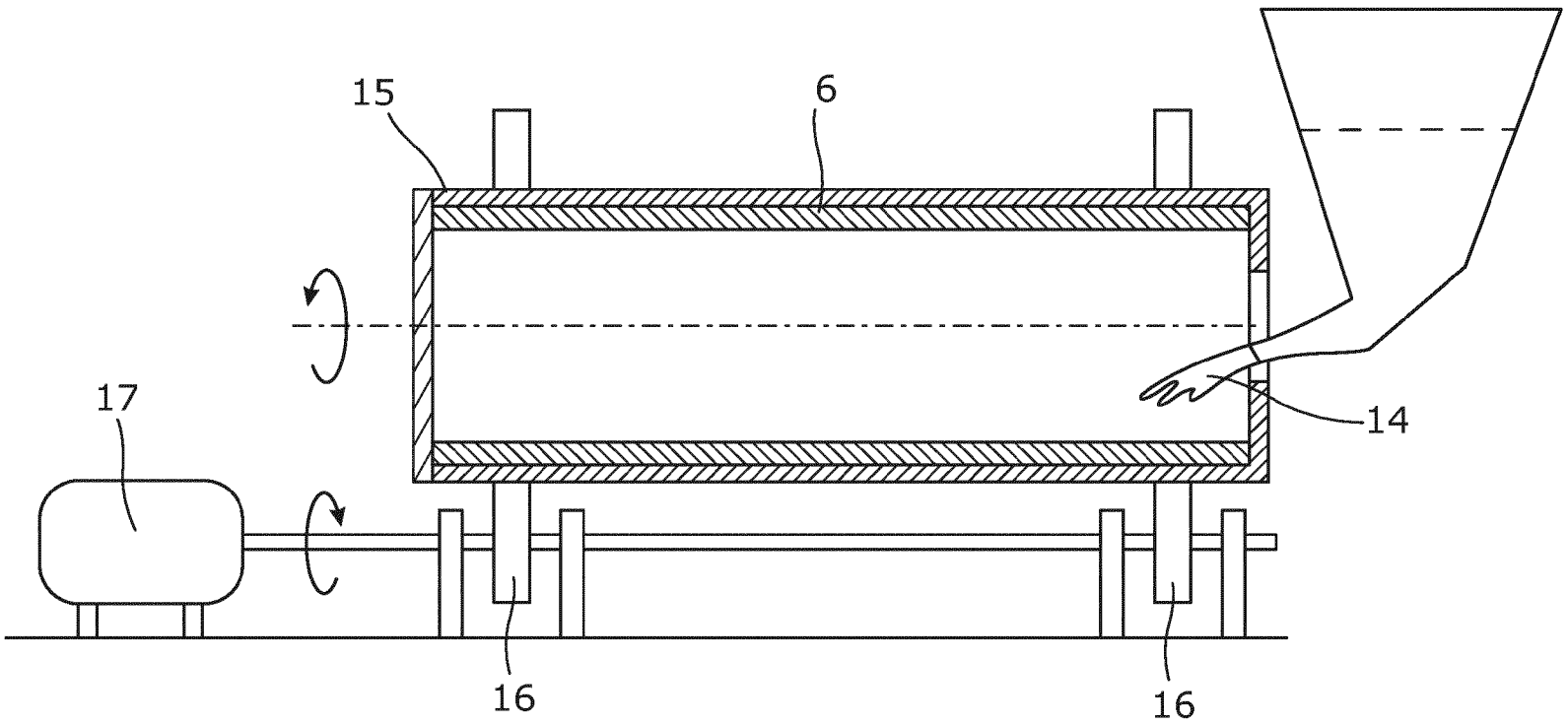
FIG. 2 shows an illustration of a centrifugal casting machinery.

The metal tubular blank may be made by centrifugal or spin casting. In centrifugal or spin casting as shown in FIG. 2, melted metal material 14 is poured into a rotating mould 15. The material is thus forced radially outwards to form the tubular blank 6. Rollers 16 underneath the mould are rotated by means of a motor 17 rotating the mould as the melted material is poured into the mould. In another embodiment of the casting equipment, a jet jetting the melted material is rotated and translated back and forth in a controlled manner within the mould to form the blank.

Figure 3:
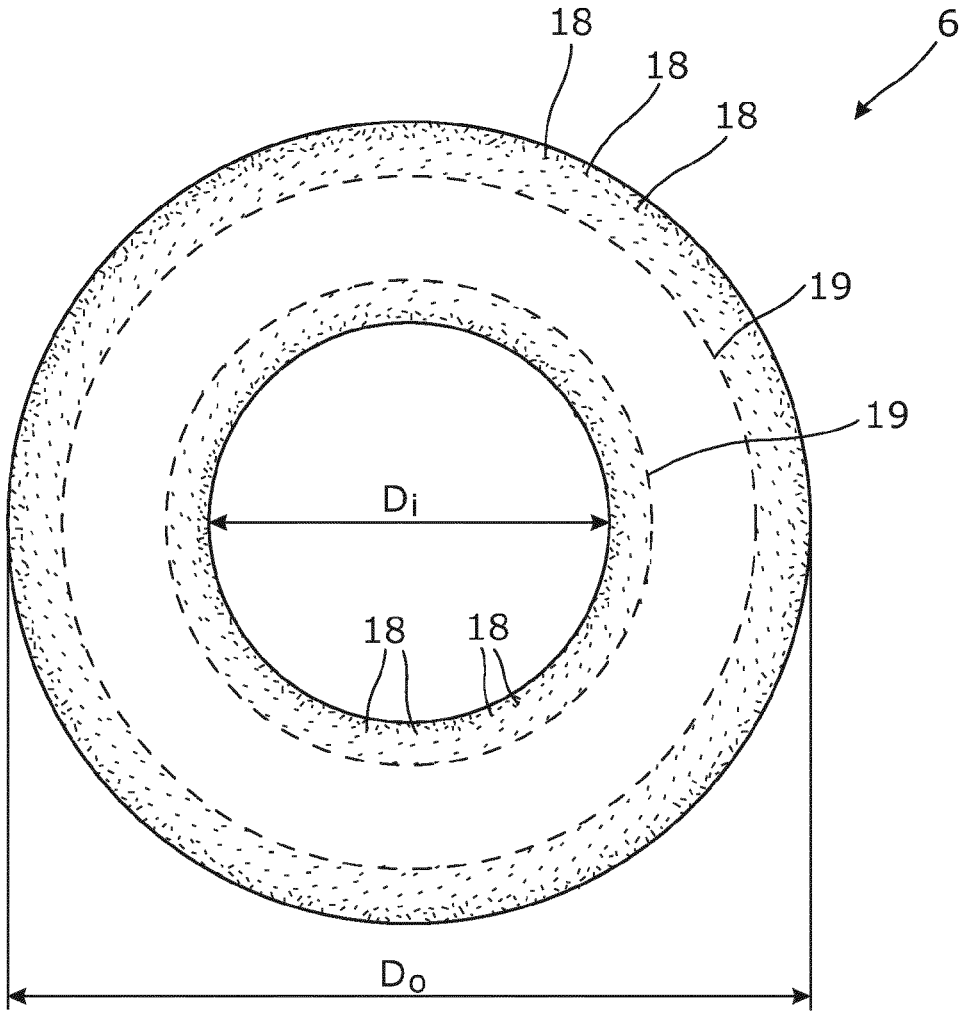
FIG. 3 shows a metal tubular blank seen from one end.

As the material cools down or is quenched, the tubular metal blank is formed as shown from one end in FIG. 3. Impurities 18 in the material are located near the surface of the blank, and as the blank is machined and material is removed to form the downhole expandable tubular having projections, the impurities are also removed, leaving a tubular having a very low content of impurities. This tubular made of a very uniform material or "pure" material with a low content of impurities is indicated with the dotted lines 19 in FIG. 3. The material with the low content of impurities has a higher ductility than the border material having a higher impurity content. Furthermore, tests have shown that the metallic bonds are maintained by centrifugal or spin casting so that the ductility of the metal is maintained during the casting process. The layers of melt forming the blank cool down and do not always have to be subjected to a subsequent tempering process. Tests have shown that the downhole expandable tubular formed from a centrifugal casted blank can be expanded by up to 58.8% without fracturing. Therefore, by manufacturing the blank by means of centrifugal or spin casting in a more ductile metal material, the downhole expandable tubular can be expanded by up to 75% without fracturing. Prior art expandable tubulars in comparison can be expanded by up to approximately 15-30% without fracturing. The high ductility is also due to the fact that welding of rings to form projections can be avoided because the projections are made during the machining of the blank to form the expandable tubular.

When using some metal types, the blank is heat-treated, and when using other metal types, the blank is not subjected to heat treatment or a tempering process. Thus, the need for tempering or heat treatment depends on the metal material used.

Figure 11:
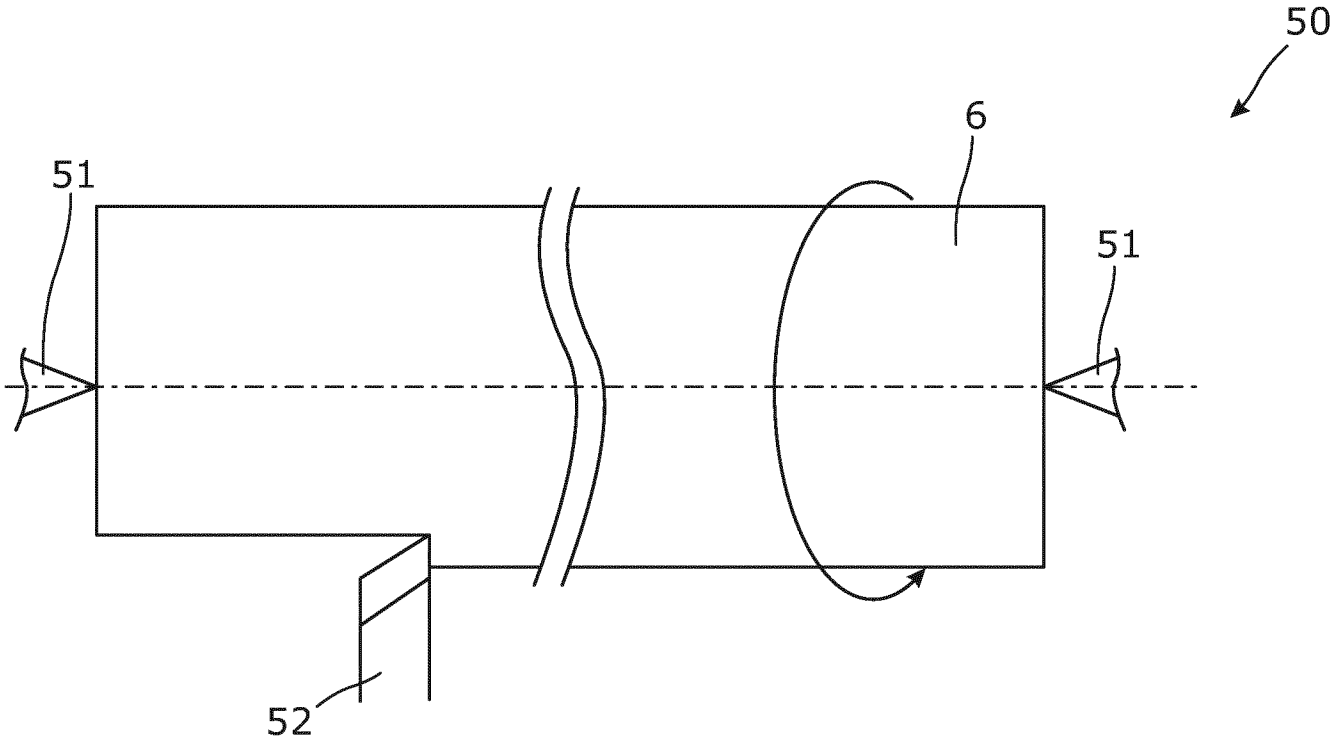
FIG. 11 shows part of a lathe machine machining a tubular blank.

The tubular blank of FIG. 3 has an inner diameter $D_i$ and an outer diameter $D_o$, and the blank is machined so as to increase the inner diameter $D_i$ and decrease the outer diameter $D_o$ to remove the material with the highest content of impurities. The machining is performed by means of milling, cutting, grinding, latheing or by means of similar machining methods for removing material from the blank to form the downhole expandable tubular. In FIG. 11, metal material is being removed from the tubular blank in a lathe machine 50 to form the expandable tubular 1. The tubular blank is fastened between two points 51, and a lathe bit 52 is machining material away from the blank 6. As shown in FIG. 11, the tubular blank may be a solid cylinder or a hollow cylinder as shown in FIG. 3. The tubular blank is made from any suitable metal material, such as steel or stainless steel.

As can be seen in FIG. 1, the downhole expandable tubular has a length l, and the downhole expandable tubular 1 is machined along the entire length, thus removing material from the blank to form the downhole expandable tubular 1 of a "pure" material.

Figure 4:
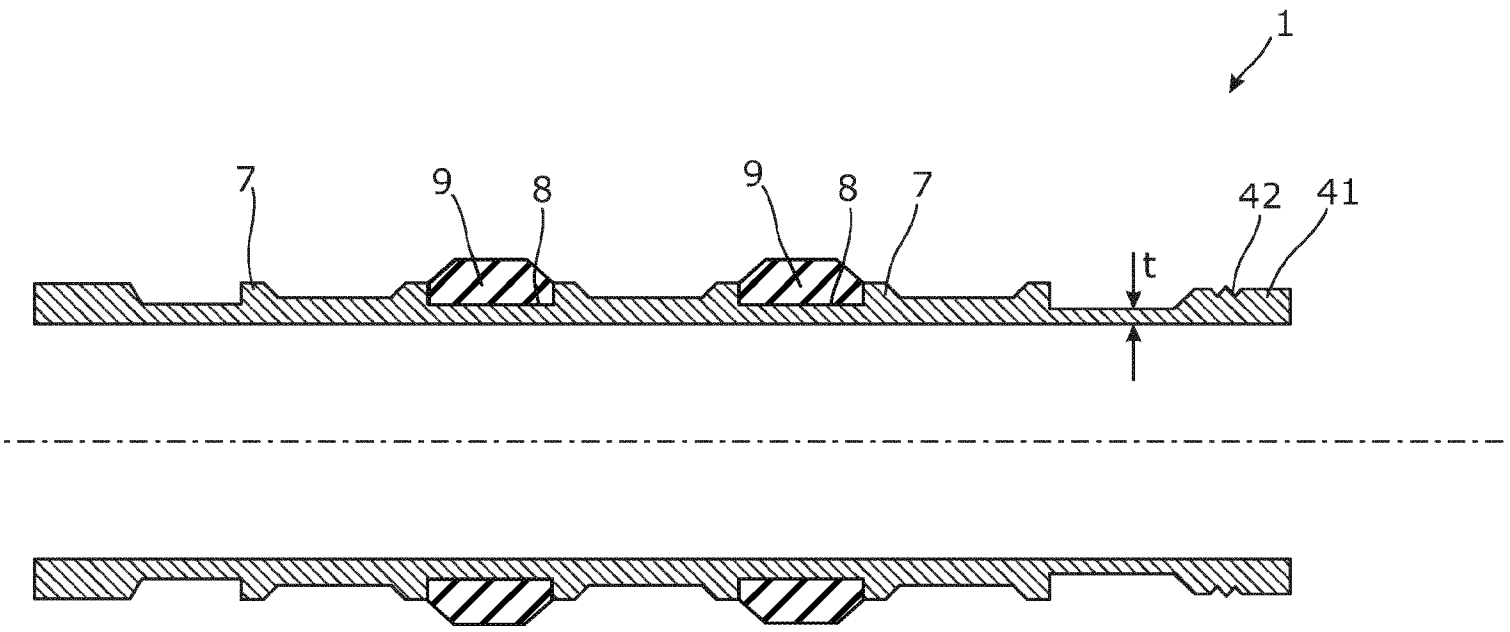
FIG. 4 shows a cross-sectional view of a downhole expandable tubular having sealing elements.

In FIG. 4, a sealing element 9 is arranged in the groove 8 and between two projections 7. As can be seen, the thickness t of the expandable tubular 1 is not the same in the groove as between two adjacent projections which are not adjacent the same groove. In another embodiment, the sealing element 9 may be arranged merely between two adjacent projections, so that the downhole expandable tubular 1 does not have grooves and thus has the same thickness t between the projections 7 and opposite the sealing element 9.

Figure 8:
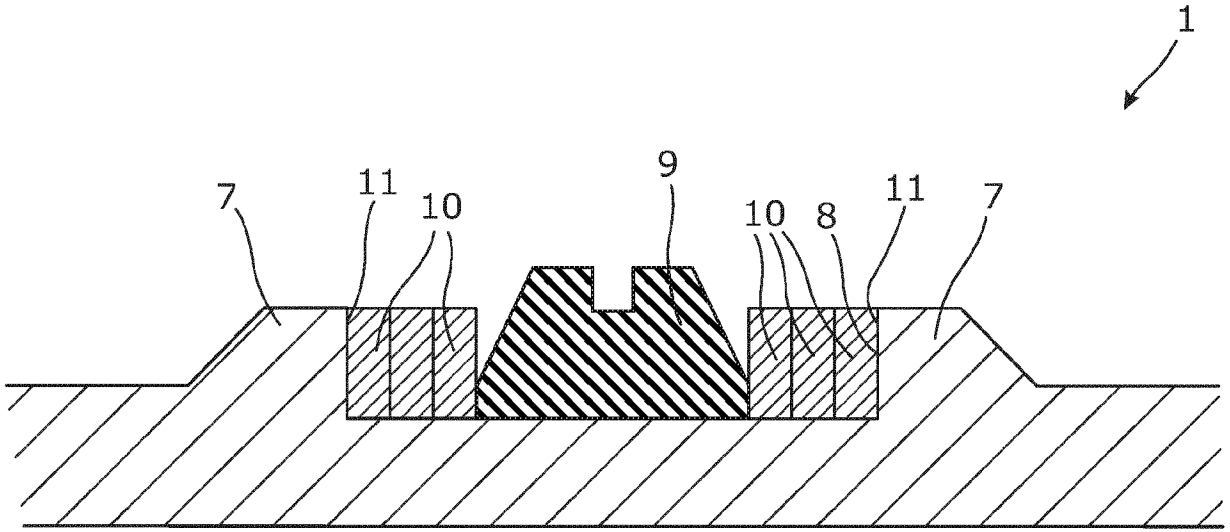
FIG. 8 shows an enlarged cross-sectional view of a downhole expandable tubular having a sealing element and two retainer elements.

As shown in FIG. 8, in order to maintain the sealing element 9 in place, also during expansion of the downhole expandable tubular 1, a ring-shaped retainer element 10 is arranged between two adjacent projections 7 or in the groove 8 for pressing the sealing element 9 in the axial extension towards an edge 11 of the projection or groove. The retainer element 10 functions as a back-up ring for the sealing element, so that the sealing element 9 is not squeezed in between the expandable tubular and the inner face of the borehole or casing when the expandable tubular is expanded. The retainer element is a split ring with several windings and is made of a metal material. When the expandable tubular is expanded by 30%, the retainer element 10 is partly "unwound" by 30% of the circumference of the retainer element 10, and thus the retainer element decreases its number of windings so that it is still capable of pressing the sealing element against the edge of the groove or the projection. As shown, a retainer element 10 is arranged on opposite sides of the sealing element 9 squeezing the sealing element along its circumferential edges. Each retainer element 10 in FIG. 8 has approximately 3.5 windings, and after expansion of the expandable tubular, the retainer element 10 has approximately 2.7 windings and thus maintains its extension in the axial extension of the expandable tubular even though the retainer element has been partly unwound.

The retainer element may also be made of a spring material, so that when the downhole expandable tubular 1 is expanded, the retainer element is also expanded, resulting in an inherent spring force in the retainer element. However, the spring effect of the metal is not essential to the operation of the retainer ring.

Figure 9:
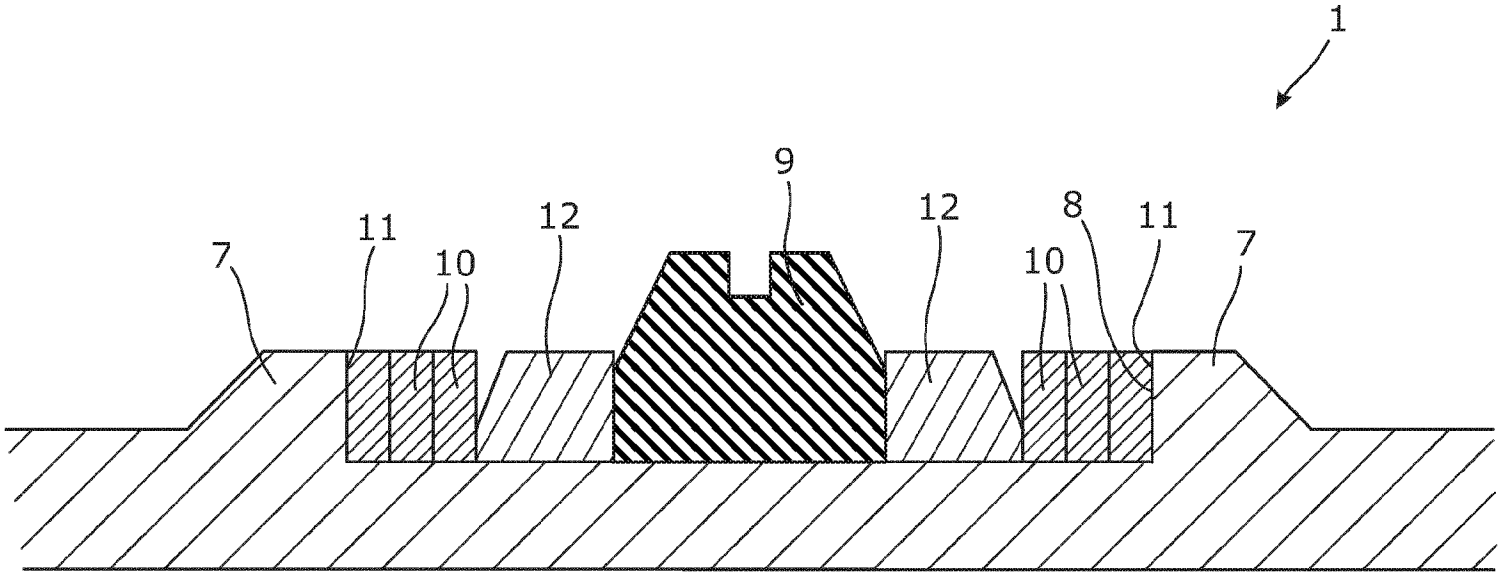
FIG. 9 shows an enlarged cross-sectional view of a downhole expandable tubular having an intermediate element between a sealing element and two retainer elements.

As shown in FIG. 9, an intermediate element 12 is arranged between the ring-shaped retaining element 10 and the sealing element 9. The sealing element 9 is typically made of an elastomeric material and the retainer element is made of a metallic material, and in order to protect the sealing element, the intermediate element arranged therebetween is made of non-metallic material which is less flexible than the sealing material.

Figure 5:
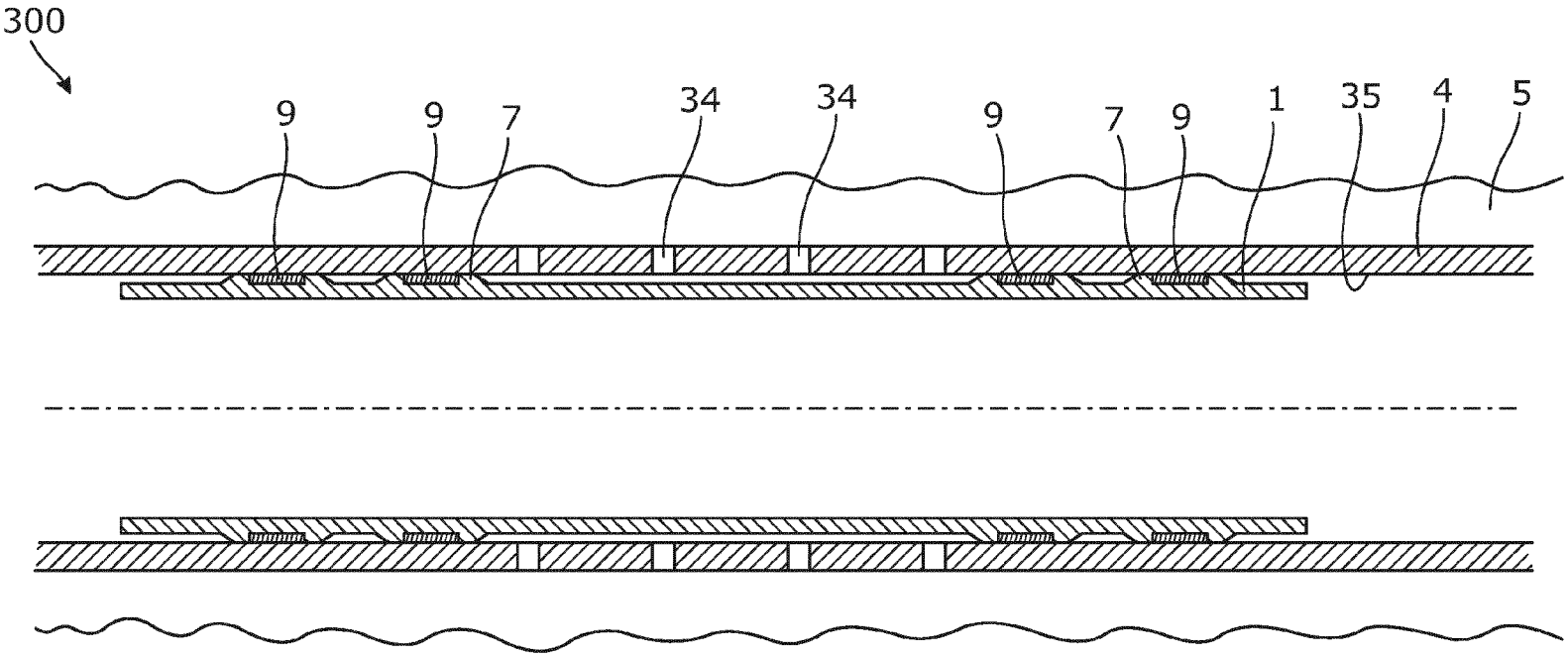
FIG. 5 shows a cross-sectional view of a downhole expandable tubular in the form of a patch.

In FIG. 5, the downhole expandable tubular 1 is a patch which is expanded within a casing 4 part of a well tubular structure 300 in a well. The patch is typically used for sealing off a leak or a perforated zone of openings 34 in the casing. The downhole expandable tubular 1 is inserted into the casing 4 having a first diameter, and when positioned opposite the openings 34, the expandable tubular is expanded to a second and larger diameter until the sealing elements 9 are squeezed in between the downhole expandable tubular 1 and the inner face 35 of the casing 4. Since the sealing elements 9 are arranged between projections 7 on opposite sites of the perforated zone of openings 34, the zone is sealed off and the well fluid from the formation is prevented from flowing in through the openings 34.

Figure 6:
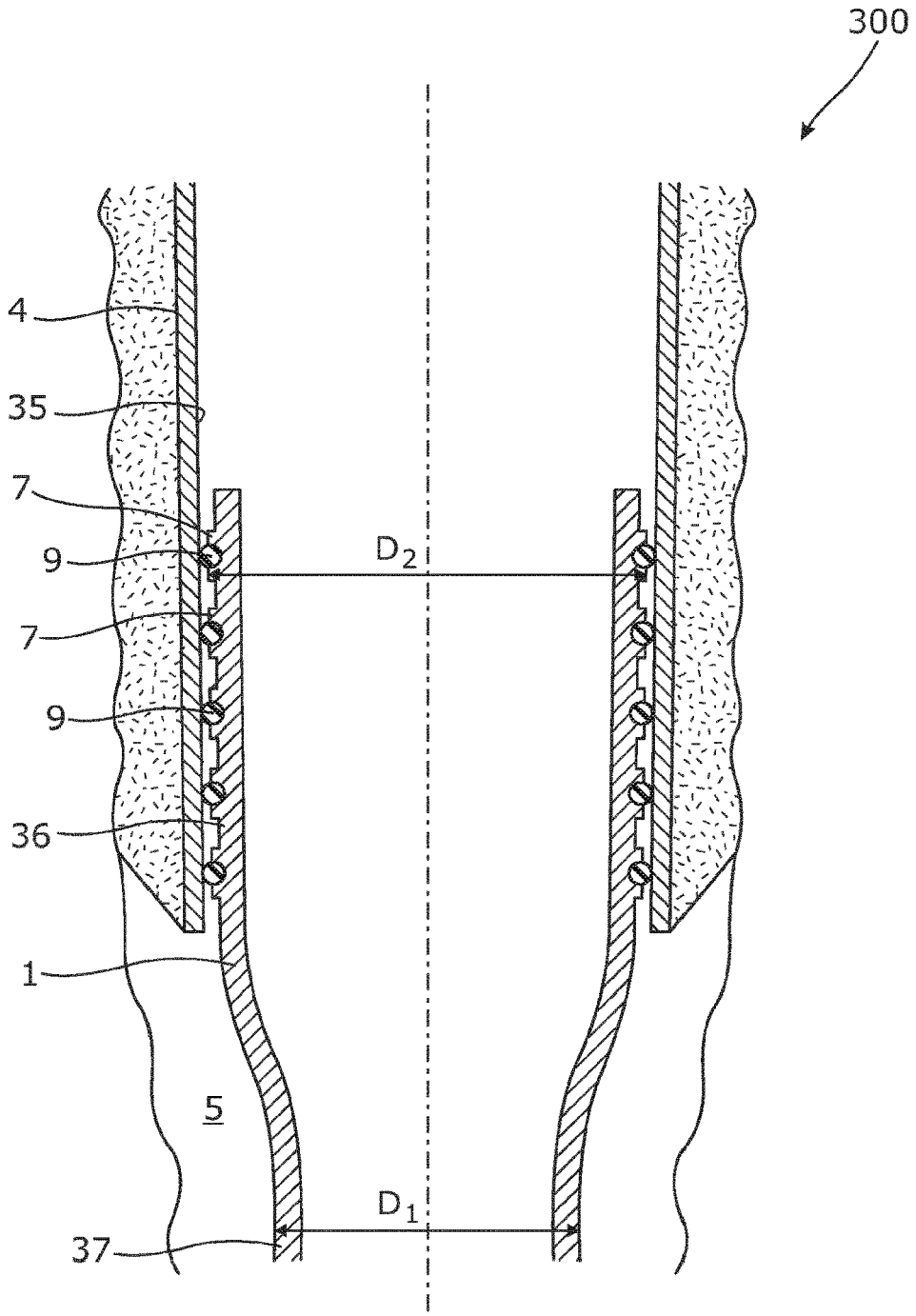
FIG. 6 shows a cross-sectional view of a downhole expandable tubular in the form of a liner hanger.

In FIG. 6, the downhole expandable tubular 1 is a liner hanger where the downhole expandable tubular 1 has been partly expanded within an upper casing 4 forming part of a well tubular structure 300 in a well. The downhole expandable tubular 1 has a first part 36 arranged opposite the upper casing 4 and a second part 37 arranged beneath the upper casing. The first part of the downhole expandable tubular 1 has been expanded until the sealing elements 9 are squeezed against the inner face 35 of the casing and the second part of the downhole expandable tubular 1 remains unexpanded.

Figure 7:
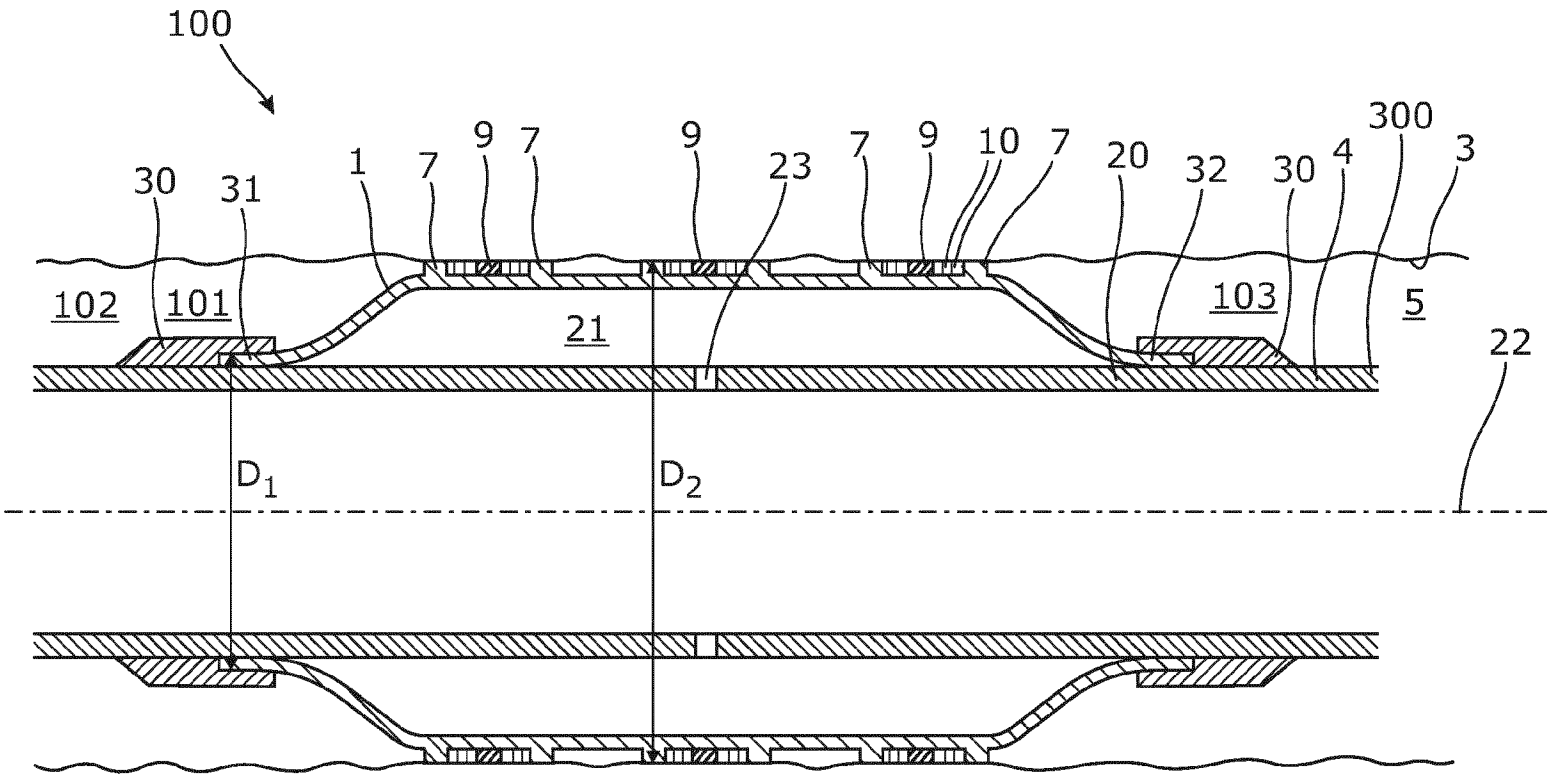
FIG. 7 shows a cross-sectional view of an annular barrier comprising a downhole expandable tubular.

FIG. 7 shows a cross-sectional view of an annular barrier 100 which has been expanded in an annulus 101 between a well tubular structure 300 and an inside face 3 of the borehole 5. The annular barrier provides zone isolation between a first zone 102 and a second zone 103 of the borehole. The annular barrier has an axial extension 22 which coincides with the longitudinal extension of the casing and well tubular structure. The annular barrier comprises a tubular part 20, which may be a separate tubular part or a casing part for mounting a part of the well tubular structure 300. Furthermore, the annular barrier comprises the downhole expandable tubular 1 which surrounds the tubular part, and each end 31, 32 of the expandable tubular 1 is connected with the tubular part by means of connection parts 30. The downhole expandable tubular 1 and the tubular metal part 20 enclose an annular barrier space 21, and an expansion opening 23 is provided in the tubular part through which fluid may enter the space in order to expand the expandable tubular as shown in FIG. 7. The downhole expandable tubular 1 is expanded until the sealing elements or the projections abut the inner face 3 of the borehole 5, so that fluid is prevented from flowing freely from the first zone 102 to the second zone 103.

As seen in FIG. 4, the downhole expandable tubular 1 may be machined having at least one integrated end piece 41, so that the ends of the expandable tubular have an increased thickness 1 in relation to the sections of the grooves. The end of the expandable tubular can then be welded to the tubular part (20 on FIG. 7) instead of having separate connection parts for fastening the expandable tubular to the tubular part in the annular barrier. One or both end pieces may have indentations 42 on an outer face of the expandable tubular, so that when the expandable tubular is expanded, the end piece 41 is able to bend outwards from the tubular part.

Figure 10:
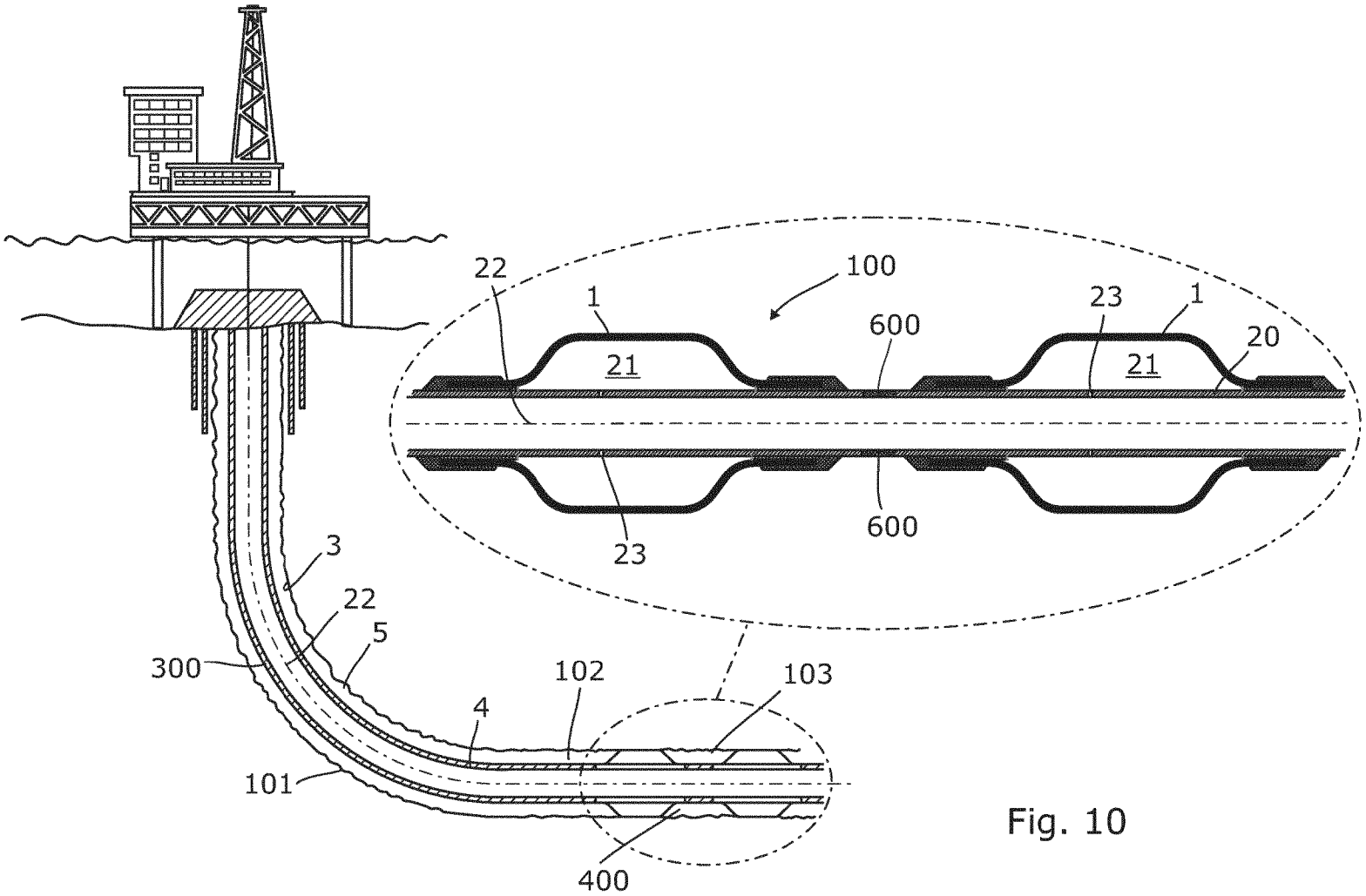
FIG. 10 shows a downhole completion having an annular barrier with a downhole expandable tubular.

As shown in FIG. 10, two annular barriers 100 are often used to isolate a production zone 400. A fracturing valve or section 600, also called the frac port, is arranged in between the annular barriers, so that when the annular barriers have been expanded, the frac port 600 is opened and fluid is let into the formation for creating fractures in the formation to ease the flow of hydrocarbon-containing fluid, such as oil, into the well tubular structure. The fracturing valve or section 600 may also comprise an inlet section which may be the same as the frac port. A screen may be arranged so that the fluid is filtered before flowing into the casing.

Figure 12:
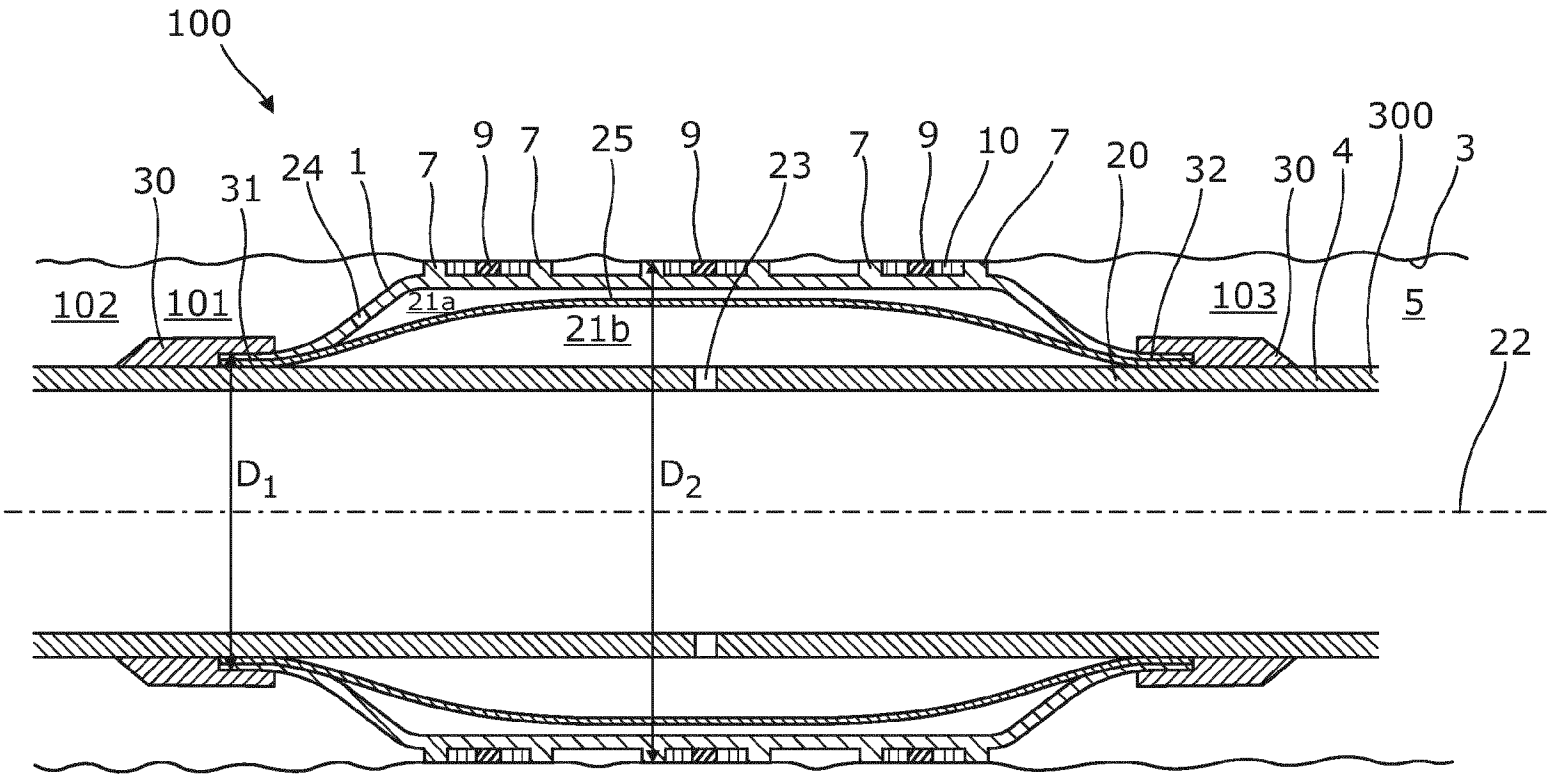
FIG. 12 shows another annular barrier having an intermediate sleeve for equalising the pressure across the downhole expandable tubular.

Furthermore, the annular barrier may further comprise at least one sealing element 9 surrounding the downhole expandable tubular 1 as shown in FIGS. 7 and 12. As shown in FIG. 12, the annular barrier further comprises a sleeve 25 arranged in between the downhole expandable tubular 1 and the tubular part 20. The sleeve 25 is connected with the tubular part 20 and the downhole expandable tubular 1, thus dividing the space into a first space section 21*a* and a second space section 21*b*. The sleeve is squeezed in between the tubular part and the downhole expandable tubular. The sleeve 25 may also be connected with the tubular part in another manner, such as crimped onto the tubular part. In order to equalise the pressure, the downhole expandable tubular has an opening 24 providing fluid communication between the first or the second zone and one of the space sections, thus equalising the pressure between the space and that zone. When e.g. performing hydraulic fracturing or another well treatment, the pressure in one of the zones in which hydraulic fracturing is performed is increasing, and in order to prevent the expandable tubular from collapsing, the fluid is let in through the opening 24 and into the first space section 21*a*. When exposed to the increased pressure, the sleeve 25 moves towards the tubular part, thus yielding to the increased pressure in the first space section 21*a*, and the first space 21*a* increases until the pressure equalises or the sleeve abuts the tubular part.

The downhole expandable tubular part may also be crimped onto the tubular part, or, if the annular barrier comprises a sleeve, crimped onto the sleeve at its ends. The sleeve is flexible and made of metal or a polymer, such as elastomer. As shown in FIG. 12, the projection is a ring-shaped projection of an increased thickness in relation to other parts of the downhole expandable tubular, the ring-shaped projection providing an enforcement of the annular barrier when the annular barrier is expanded.

In FIG. 12, the ring-shaped retaining element 10 of the annular barrier is a split ring having three windings. In the annular barriers shown in FIGS. 7 and 12, the ends of the downhole expandable tubular may be welded to the tubular part, or the downhole expandable tubular may be crimped onto the tubular part. One end of the downhole expandable tubular may be sliding in relation to the tubular part.

The expandable tubular is made without any subsequent welding process, but the expandable tubular may be welded for connection with other components, such as a base pipe/tubular part of an annular barrier, or the expandable tubular may be connected with other components by other connection processes, e.g. it may be clamped onto the base pipe.

The tubular blank may be made of any kind of metal, such as iron, steel or stainless steel, or more ductile materials, such as copper, aluminium, lead, tin, nickel, polymers, elastomers, rubber or a combination thereof.

A stroking tool is a tool providing an axial force. The stroking tool comprises an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole expandable tubular to be expanded in a well downhole from a first outer diameter ($D_1$) to a second outer diameter ($D_2$) to abut against an inner face of a casing or borehole, the downhole expandable tubular having an axial extension, wherein the downhole expandable tubular is made of metal and is machined from one metal tubular blank, providing the downhole expandable tubular with at least one circumferential projection extending entirely around the expandable tubular along a plane substantially perpendicular to the axial extension, and wherein the metal tubular blank is made by centrifugal or spin casting.

2. The downhole expandable tubular according to claim 1, wherein the downhole expandable tubular is machined, providing the downhole expandable tubular with at least one groove.

3. The downhole expandable tubular according to claim 1, wherein the machining is performed as milling, cutting or grinding or latheing.

4. The downhole expandable tubular according to claim 1, wherein the tubular blank has an inner diameter ($D_i$) and an outer diameter ($D_o$), said blank being machined so as to increase the inner diameter ($D_i$) and/or decrease the outer diameter ($D_o$).

5. The downhole expandable tubular according to claim 1, wherein the tubular blank is made from steel or stainless steel.

6. The downhole expandable tubular according to claim 1, wherein the downhole expandable tubular has a length and the downhole expandable tubular is machined along the entire length.

7. The downhole expandable tubular according to claim 1, wherein the downhole expandable tubular comprises several projections and/or at least one groove.

8. The downhole expandable tubular according to claim 7, wherein a sealing element is arranged between two adjacent projections or in the groove.

9. The downhole expandable tubular according to claim 8, wherein a ring-shaped retaining element is arranged between two adjacent projections or in the groove for pressing the sealing element in the axial extension towards an edge of the projection or groove.

10. The downhole expandable tubular according to claim 9, wherein the ring-shaped retaining element is a split ring.

11. The downhole expandable tubular according to claim 9, wherein an intermediate element is arranged between the ring-shaped retaining element and the sealing element.

12. The downhole expandable tubular according to claim 1, wherein the downhole expandable tubular is a patch to be expanded within a casing or well tubular structure in a well, a liner hanger to be at least partly expanded within a casing or well tubular structure in a well, or a casing to be at least partly expanded within another casing.

13. An annular barrier to be expanded in an annulus between a well tubular structure and an inside face of a casing or borehole downhole for providing zone isolation between a first zone and a second zone of the casing or borehole, the annular barrier having an axial extension and comprising:

a tubular part, the tubular part being a separate tubular part or a casing part for mounting a part of the well tubular structure, the downhole expandable tubular according to claim 1, the expandable tubular surrounding the tubular part, each end of the expandable tubular being connected with the tubular part and extending along the axial extension, an annular barrier space between the tubular part and the expandable tubular, and an expansion opening in the tubular part through which fluid may enter the space in order to expand the expandable tubular.

14. The annular barrier according to claim 13, further comprising at least one sealing element surrounding the downhole expandable tubular.

15. The annular barrier according to claim 13, wherein the downhole expandable tubular has an opening providing fluid communication between the first or the second zone and one of the space sections.

16. The annular barrier according to claim 13, wherein the projection is a ring-shaped projection of an increased thickness in relation to other parts of the downhole expandable tubular, the ring-shaped projection providing an enforcement of the annular barrier when the annular barrier is expanded.

17. A downhole completion comprising a well tubular structure and an annular barrier according to claim 13, where the tubular part of the annular barriers is mounted as part of the well tubular structure.

18. A downhole completion comprising a downhole expandable tubular according to claim 1, and a casing having an inner face against which at least part of the downhole expandable tubular is expanded.

19. A manufacturing method for the manufacture of the downhole expandable tubular according to claim 1, comprising:

machining the metal tubular blank to a decreased inner and outer diameter, and machining the metal tubular blank, providing it with at least one circumferential projection or groove.

* * * * *